US005511909A

United States Patent [19]

Calandra, Jr. et al.

[11] Patent Number: 5,511,909

[45] Date of Patent: Apr. 30, 1996

[54] CABLE BOLT AND METHOD OF USE IN SUPPORTING A ROCK FORMATION

[75] Inventors: Frank Calandra, Jr., Pittsburgh; John C. Stankus, Canonsburg; John G. Oldsen, Butler, all of Pa.

[73] Assignee: Jennmar Corporation, Pittsburgh, Pa.

[21] Appl. No.: 255,077

[22] Filed: Jun. 7, 1994

[51] Int. Cl.[6] ..... F21D 21/02

[52] U.S. Cl. ..... 405/259.6; 405/259.1; 405/502.2

[58] Field of Search ..... 405/302.2, 259.1–259.6; 411/267–270, 433, 50–51

[56] References Cited

U.S. PATENT DOCUMENTS

| | | | |
|---|---|---|---|
| 2,850,937 | 4/1955 | Ralston | 85/62 |
| 2,970,444 | 3/1958 | Peter | 61/45 |
| 3,058,386 | 10/1962 | Morrow | 411/267 X |
| 3,505,824 | 4/1970 | White | 405/302.2 |
| 3,650,112 | 3/1972 | Howlett et al. | 61/35 |
| 4,140,428 | 2/1979 | McLaine et al. | 405/261 |
| 4,449,855 | 5/1984 | Langwadt | 405/260 |
| 4,648,753 | 3/1987 | Stephan | 405/260 |
| 4,798,501 | 1/1989 | Spies | 405/260 |
| 4,832,534 | 5/1989 | Duvieusart | 405/261 |
| 4,884,377 | 12/1989 | Matt | 52/98 |
| 5,230,589 | 7/1993 | Gillespie | 405/259.6 |
| 5,244,314 | 9/1993 | Calandra, Jr. et al. | 405/259.4 |
| 5,253,960 | 10/1993 | Scott | 405/259.1 X |
| 5,259,703 | 11/1993 | Gillespie | 405/259.6 |

FOREIGN PATENT DOCUMENTS

| | | | |
|---|---|---|---|
| 2686915 | 8/1993 | France | 405/259.1 |
| 1143471 | 2/1963 | Germany . | |
| 6116948 | 4/1994 | Japan | 405/259.1 |
| 407014 | 8/1966 | Switzerland . | |
| 943667 | 12/1963 | United Kingdom . | |

OTHER PUBLICATIONS

"Laboratory Evaluation of Cable Bolt Supports", United States Department of Interior, Report of Investigations No. 9308, J. M. Goris, 1990.

"Laboratory Evaluation of Cable Bolt Supports", United States Department of Interior, Report of Investigations No. 9342, J. M. Goris 1991.

"Cable Bolting", *The Mining Engineer*, G. Daw, Feb. 1991.

"Evaluation of Cable Bolt Supports At The Hamostake Mine", *Cim Bulletin*, J. M. Goris, F. Duan, J. Pfarr Mar. 1991.

"Cable Bolted Slicing of Thick Seam Standing of Pillars", *Journal of mines, metals & Fuels*, T. N. Singh.

(List continued on next page.)

*Primary Examiner*—David J. Bagnell
*Assistant Examiner*—Frederick L. Lagman
*Attorney, Agent, or Firm*—Webb Ziesenheim Bruening Logsdon Orkin & Hanson

[57] ABSTRACT

A flexible multi-strand steel cable of a preselected length is inserted in a bore hole drilled in a rock formation above an underground excavation. The cable includes an anchor end portion positioned in the bore hole for frictionally engaging the cable to the wall of the bore hole. The anchor end portion may also be chemically bonded to the surrounding rock formation. The cable extends out of the bore hole and includes a drive end portion that retains a bearing plate opposite the opening into the bore hole. The drive end portion includes a pair of diametrically positioned jaw members on the cable. The jaw members form a frustoconical outer surface positioned within a tapered bore of a collar. The collar advances on the jaw members to compress them into nonrotational gripping engagement with the steel cable. End portions of the jaw members extend out of the collar on the cable. A torque transmitting device engages the ends of the jaw members removed from contact with the collar to transmit upward thrust and rotation through the jaw members to the cable and place the anchored cable in tension to reinforce the overlying strata of the rock formation.

23 Claims, 4 Drawing Sheets

OTHER PUBLICATIONS

R. N. Gupta, B. K. Dubey, B. P. Verma, B. Singh, Jul. 1986
Florida Wire and Cable Company–"Flo–Tech Systems".
F. M. Locotos–"Super Flex Bolt".
BLM Mincom Inc. "Preformed Cable Anchor".
Dywidag Systems International, USA, Inc.–"Passive Cable Bolt".

Dywidag Systems International, USA, Inc. "Tensionable Cable Bolt".

Rocky Mountain Bolt Company "A New Twist on Roof Support".

CABLE BOLT AND METHOD OF USE IN SUPPORTING A ROCK FORMATION

BACKGROUND OF THE INVENTION

1. Field of the Invention

This invention relates to method and apparatus for supporting a rock formation above an underground excavation and, more particularly, to a flexible multi-strand steel cable anchored in a bore hole of the rock formation to reinforce the strata of the rock formation.

2. Description of the Prior Art

It is well known to reinforce and stabilize underground rock formations, such as a coal mine roof, a subway tunnel or similar subterranean structure or to strengthen a rock mass by the use of anchor bolts inserted within bore holes drilled in the rock formation. U.S. Pat. No. 5,244,314 discloses the type of anchor bolt that utilizes a reinforcing rod of a preselected length, for example 6 to 10 feet, that is inserted in a hole drilled into the rock formation. The end of the bolt is anchored in the bore hole by either engagement of a mechanical expansion shell with the wall of the surrounding rock formation or chemically anchoring the bolt by a multi-component resin system or cement grout to the surrounding rock formation. The bolt can be anchored in the bore hole using resin or grout alone in a passive system where the bolt is not placed in tension. A bolt which is mechanically anchored in the bore hole is placed in tension, and a tensioned roof bolt can also be chemically bonded to the rock formation.

Under specific rock formation conditions it is known to use lengths of multi-strand high strength steel cables anchored in bore holes to reinforce an unstable rock formation. As with a steel bolt, a cable bolt can be both chemically and mechanically anchored in the bore hole. A cable bolt can be anchored using an expansion shell assembly, as disclosed in U.S. Pat. No. 5,244,314, or with a resin bonding system. Other types of mechanical anchors can also be used in combination with a resin bonding system to tension an anchored cable bolt.

Because of the flexible nature of a cable bolt it is particularly useful in the reinforcement of rock strata that is subject to significant horizontal shifting of the strata layers. This shifting movement generates shear forces which can break a steel bar bolt. However, a cable bolt can withstand substantial lateral deflection due to shifting of the rock strata before it breaks.

The flexibility of cable bolts is also particularly adaptable for insertion in bore holes of a considerable length, particularly where the length of the bore hole exceeds the height of the mine roof. Where steel bar bolts are installed in bore holes that exceed the height of the passageway beneath the structure to be supported, short lengths of bars must be coupled together. Each length is individually coupled to the preceding bar. The coupled bars are advanced sequentially in the bore hole. This is a time consuming and expensive task. On the other hand, cable bolts are flexible and can be bent as they are inserted in the bore holes. Thus, for example, in an underground passage having a roof height of 6 to 8 feet a continuous length of cable bolt can be efficiently inserted into a 60 foot bore hole above the passageway without coupling together sections of the bolt. A bolt of this length can be mechanically or chemically anchored in the bore hole or a combination of both systems used.

The effectiveness of a cable bolt to support a rock formation is determined to a great extent by the capacity of the cable bolt to resist pull-out under the loads exerted by fractured rock strata. A number of devices have been proposed for anchoring cable bolts in bore holes, such as steel buttons and birdcages, as described in a report published by the United States Department of the Interior, Bureau of Mines entitled "Laboratory Evaluation of Cable Bolt Supports" (in two parts) by J. M. Goris, published 1991.

In a system of anchoring a cable bolt using cement grout, buttons and birdcages increase the resistance of the cable bolt to pull-out by compressing the grout into contact with the wall of the bore hole. This increases the engagement or bonding of the grout with the surrounding rock strata. With the cable bolt adhered to the grout, the cable bolt is securely anchored within the bore hole to the surrounding rock formation.

Because of the advantages provided by the flexible nature of cable bolts to withstand shear forces generated by lateral movement of rock strata, efforts have been made to provide the cable bolt with features that facilitate rapid installation of a tensioned cable bolt. To accommodate the upward insertion of the cable in a bore hole and rotation of the bolt to effect mixing of a two component resin system, a mechanical drive head is installed on the end of the cable that extends out of the bore hole. One example of a drive head on the end of a cable bolt is disclosed in U.S. Pat. No. 4,798,501 where a roof bolting machine engages the drive head to advance it upwardly into the bore hole and rotate the entire cable bolt to effect mixing of a two component resin system. It is essential that the drive head be nonrotatably connected to the end of the cable so that the rotation is transmitted from the drive head to the cable. If the drive head is not secured to the cable, the drive head will rotate on the cable and the rotation will not be transmitted to the cable.

The combination of a gripping wedge and a drive collar with a tapered bore for preventing the drive collar from moving on the end of the cable is disclosed in a paper entitled "Cable Bolting" by G. Daws published in the February 1991 edition of The Mining Engineer. At the emergent end of the cable bolt a pair of wedges having tapered exterior surfaces is received within a cylindrical collar having a bore tapered in the opposite direction of the taper on the wedges. When the collar is advanced into surrounding relation with the wedges, the wedges are compressed into gripping engagement with the cable. The collar is frictionally engaged by the mating tapered surfaces to the wedges. Rotation transmitted to the surrounding collar rotates the entire cable to facilitate longitudinal insertion and rotation of the cable in the bore hole. A similar arrangement of an internally tapered drive collar engaging tapered wedges gripping a cable bolt is disclosed in U.S. Pat. Nos. 5,230,589 and 5,259,703.

The provision of a drive collar having a tapered bore surrounding tapered wedges on the end of a cable permits installation of a cable bolt by the same machinery used to install rebar bolts. The cable bolt can be rapidly advanced regardless of its length into the bore hole and then rotated to effect mixing of resin components and/or set an expansion shell assembly in the bore hole.

With known devices, it is the conventional practice to transmit rotation to the surrounding drive collar which is advanced on the wedges to the point where the wedges are compressed into gripping engagement with the cable. The drive collar is frictionally engaged by the mating tapered surfaces to the wedges. If the drive collar is not frictionally engaged to the wedges, then the collar can rotate or slip on the wedges and rotation is not transmitted through the wedges to the cable. If the cable does not rotate an expansion anchor can not be set or the components of a resin system mixed.

While it is known to use a combination collar and wedge set to transmit rotation to the end of a cable bolt, there is need for method and apparatus for securing a drive head to a cable bolt that eliminates the problem of slippage of the drive head on the end of the cable bolt.

SUMMARY OF THE INVENTION

In accordance with the present invention there is provided apparatus for supporting a rock formation that includes a multi-strand cable of a preselected length extending between first and second end portions. Anchor means on the cable first end portion frictionally engages a wall of a bore hole in the rock formation. A plug member has an axial bore for engaging the cable second end portion, a reduced end portion, an enlarged end portion, and an outer surface tapering from the reduced end portion to the enlarged end portion. A housing has a bore for receiving the plug member. The housing bore is tapered in a direction opposite to the direction of taper of the plug member outer surface to permit the housing to advance on the plug member and urge the plug member into frictional engagement with the cable. Means for limiting advance of the housing on the plug member permits the plug member enlarged end portion to extend out of the housing to receive torque for transmitting rotation from the plug member to the cable.

Further in accordance with the present invention there is provided a method for supporting a rock formation comprising the steps of installing an anchor assembly on one end of a multi-strand cable of a preselected length. The anchor assembly is advanced with the cable in a bore hole of the rock formation to position the anchor assembly at a preselected depth in the bore hole. An opposite end of the cable extends out of the bore hole. A plug member positioned on the end of the cable extends out of the bore hole. A housing is advanced into wedging engagement with the outer surface of the plug member to urge the plug member into nonrotational gripping engagement with the cable. An end portion of the plug member surrounding the end of the cable extends beyond the housing. An upward force is applied to the end of the plug member to advance the anchor assembly in the bore hole wall into engagement with the surrounding rock formation to anchor the cable in the bore hole to support the rock formation.

In addition, the present invention is directed to a drive assembly for an end of a flexible cable that includes a chuck formed by a pair of jaw members positioned in opposed relation with an axial bore extending therethrough for receiving the end of a flexible cable. The pair of jaw members have frustoconical outer surfaces tapering in diameter from an enlarged end portion to a reduced end portion. A housing has a bore for receiving the plug member. The housing bore is tapered in a direction opposite to the direction of taper of the frustoconical outer surfaces of the jaw members. The housing is positioned in surrounding relation with the jaw members and axial advanced on the frustoconical outer surfaces from the reduced end portion to the enlarged end portion to urge the jaw members into nonrotatable gripping engagement with the flexible cable. Stop means extends from the enlarged end portion of the jaw members for receiving the housing in a fixed position compressing the jaws on the cable. The stop means has a surface extending axially from the housing for receiving a drive mechanism for transmitting torque or thrust to the cable.

Accordingly, a principal object of the present invention is to provide method and apparatus for supporting the overhead rock strata of an underground excavation by a selected length of flexible cable anchored in a bore hole drilled into the rock strata.

Another object of the present invention is to provide a cable bolt for supporting a mine roof where the cable bolt is anchored by mechanical or chemical means or by combination of both in a bore hole drilled in the mine roof to permit the cable bolt to be placed in tension so as to compress and stabilize the rock strata above the mine roof.

A further object of the present invention is to provide method and apparatus for supporting an underground formation by a cable bolt anchored under tension in a bore hole to reinforce overhead rock strata.

An additional object of the present invention is to provide a drive assembly for the end of a cable bolt that permits rapid upward insertion and engagement of a length of cable in a bore hole of an overhead rock formation.

These and other objects of the present invention will be more completely disclosed and described in the following specification, the accompanying drawings, and the appended claims.

DESCRIPTION OF THE PREFERRED EMBODIMENTS

Figure 1:
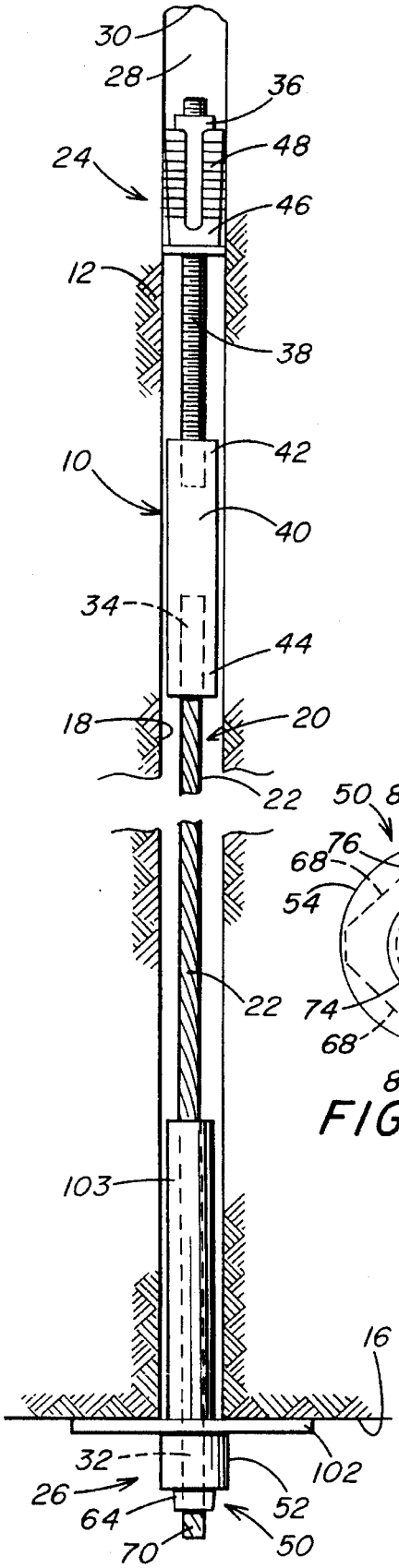
FIG. 1 is a view in side elevation of a cable bolt in accordance with the present invention.

Referring to the drawings and particularly to FIGS. 1–5, there is illustrated in FIG. 1 apparatus generally designated by the numeral 10 for supporting a rock formation 12 above an underground excavation 14. The rock formation 12 can include, for example, a mine roof 16 that overlies a mine passageway, shaft, subway tunnel, or other similar subterranean structure. It should also be understood that the support apparatus 10 of the present invention can be utilized to support a rock formation where the apparatus 10 extends from above ground downwardly into a bore hole 18 drilled into a rock formation below ground level.

The apparatus 10 includes a cable bolt generally designated by the numeral 20. The bolt 20 is formed of a selected length of a flexible multi-strand steel cable 22 having an anchor end portion generally designated by the numeral 24 and a drive end portion generally designated by the numeral 26. Between the anchor end portion 24 and the drive end portion 26, the cable 22 is flexible and extends a preselected length as determined by the length of the bore hole 18 in the rock formation 12. Because of the flexible nature of the cable bolt 20, it can be installed in bore holes of considerable length, for example, up to 60 feet or more. The cable bolt 20 is continuous in length and does not require sections of cable to be coupled together.

The cable bolt 20 is flexible so that it can be brought to the site of the bore hole 18 for installation in a bent or flexed configuration. This is very convenient for working in the underground excavation 14 where the roof height is low, for example less than 6 feet. To install a steel bar roof bolt in a bore hole 18 which is much longer than the roof height requires sections of bars to be coupled together. This is not necessary with the cable bolt 20 of the present invention where the flexible cable can be advanced from a rolled configuration upwardly into the bore hole 18.

As illustrated in FIG. 1, the length of the cable bolt 20 installed in the bore hole 18 has a length less than the depth of the bore hole. When inserted to its full depth within the bore hole 18, a space 28 remains between the anchor end portion 24 and a closed end or bottom 30 of the bore hole 18. The steel cable extends from a first end portion 32 at the drive end portion 26 of apparatus 10 to a second end portion 34 connected to the anchor end portion 24.

The cable end portion 34 is anchored in the bore hole 18 by a selected one of a number of anchor devices. The anchor device illustrated in FIG. 1 is an expansion shell assembly of the type disclosed in U.S. Pat. No. 5,244,314 which includes a camming plug 36 having an internally threaded bore for engaging the external threads of a stud 38 that is connected at its opposite end portion to a tubular fitting 40. End portion 42 of fitting 40 is internally threaded to receive the threaded end of the stud 38. Opposite end 44 of tubular fitting 40 is crimped or swaged to cable end portion 34. The length of the tubular fitting 40 and the threaded stud 38 is selective.

The camming plug 36 has a tapered external surface positioned within the expandable fingers of an expansion shell 46. Fingers 48 of the expansion shell 46 have a serrated surface for engaging the wall of the bore hole 18. The outer diameter of the expansion shell 46 corresponds substantially to the diameter of the bore hole 18 so that when the cable bolt 20 is advanced in the bore hole 18 to the position shown in FIG. 1, the fingers 48 initially engage the wall of the bore hole. Where there is sufficient resistance to rotation of the expansion shell 46 due to engagement with the wall of the bore hole, the camming plug 36 advances downwardly within the shell 46 upon rotation of the cable bolt 20 to expand the shell outwardly into secure gripping engagement with the wall of the bore hole 18.

Figure 11:
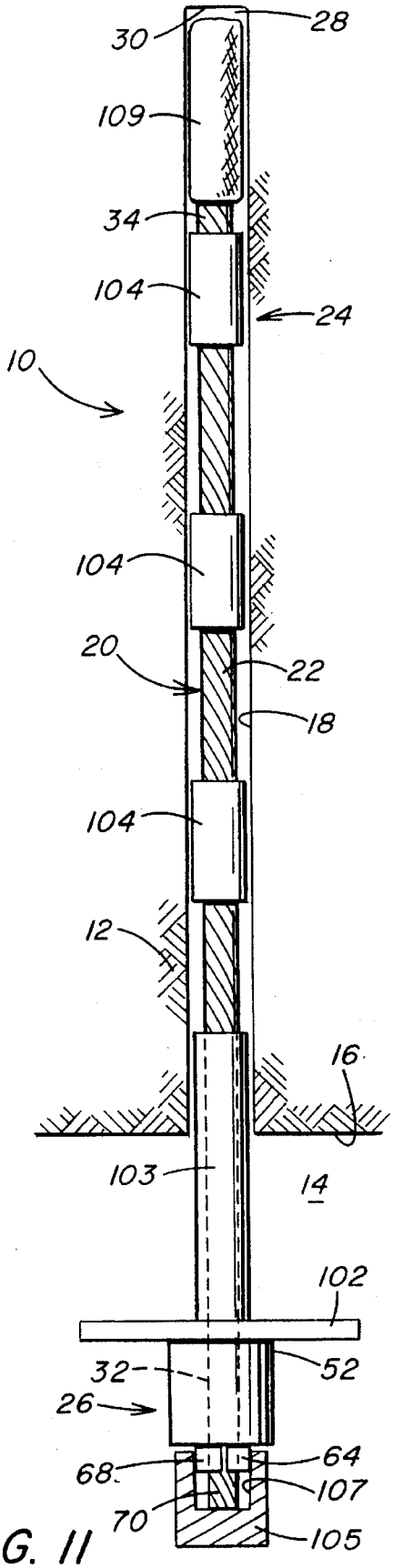
FIG. 11 is a partial sectional view in side elevation of another embodiment of a cable bolt of the present invention, illustrating a resin cartridge advanced to the end of the bore hole by the cable bolt and a portable wrench engaging the end of the cable bolt extending from the bore hole.

The cable bolt 20 of the present invention may be anchored in the rock formation 12 by the use of the mechanical expansion shell 46 alone or in combination with a chemical system that includes cement grout or a quick setting polymeric resin. In a chemical system using a quick setting resin, a dual component resin cartridge (as shown in FIG. 11) is inserted in the bore hole 18 and advanced by the cable bolt 20 to the closed end portion 30 of the bore hole.

Figure 12:
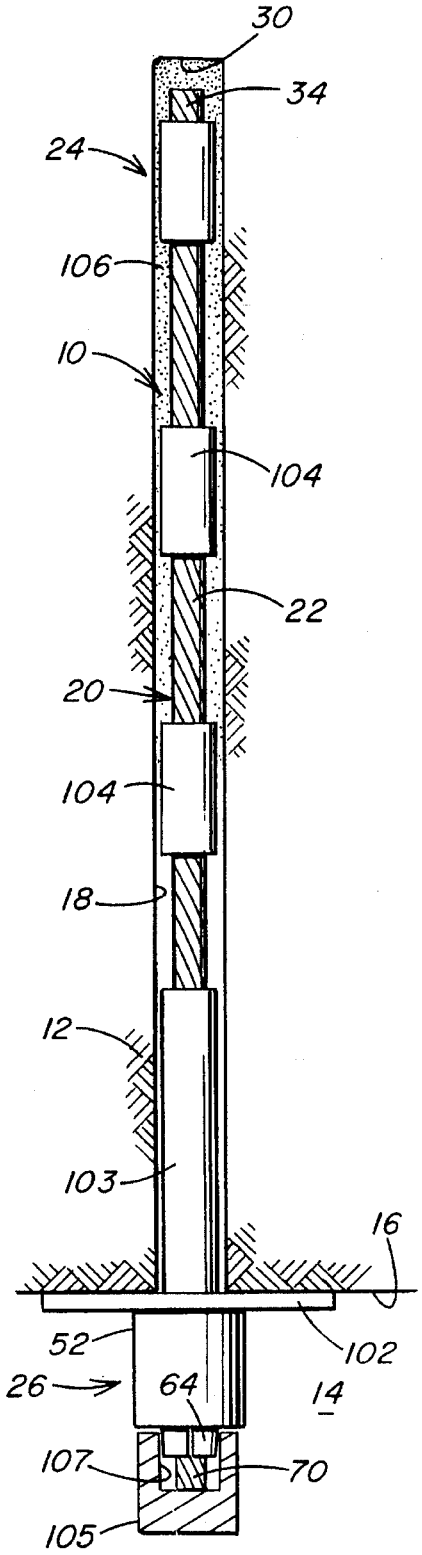
FIG. 12 is a view similar to FIG. 11, illustrating the cable bolt anchored in the bore hole by the resin mixed and cured in surrounding relation with the cable bolt in the bore hole.

The resin cartridge, as well known in the art, includes two compartments containing a polyester resin in one and a catalyst or hardener in the other. When the resin cartridge is advanced in the bore hole 18 by upward movement of the cable bolt 20, the resin cartridge is compressed between the end of the cable bolt 20 and closed end 30 of the bore hole 18. Continued upward movement of the cable bolt punctures the cartridge to release the resin components. The cable bolt 20 is then rotated by engaging the drive end portion 26 with a portable wrench as shown in FIGS. 11 and 12. The torque wrench is inserted in the drive head or chuck of a conventional mine roof drilling and bolting machine for rotating the cable bolt to mix the resin components.

It is also well known that the camming plug 36 can include a shear pin, as disclosed in U.S. Pat. No. 5,244,314 incorporated herein by reference, which maintains the plug 36 fixed relative to the rotating bolt 20 so that the camming plug 36 does not advance downwardly on the threaded stud 38 until the resin components are thoroughly mixed and the resin hardens. It is also well known to use other means for restraining rotation of the camming plug 36 on the threaded stud 38 by frictional forces between the plug 36 and the threaded stud 38 to resist relative rotation.

Up to the point where the resin components are mixed and before the mixed resin begins to harden, the camming plug 36 and expansion shell 46 rotate with the threaded stud 38. When the resin begins to harden, increased friction is placed on the anchor end portion 24. When the resistance to rotation of the plug 36 is exceeded, the shear pin breaks and the camming plug 36 moves downwardly on the threaded stud 38. The fingers 48 expand radially outwardly into gripping engagement with the wall of the bore hole 18. Rotation of the anchored cable bolt 20 places the cable bolt 20 in tension between the cable end portion 32 and the anchor end portion 24. The tensioned cable bolt 20 compresses the rock strata above the mine roof 16.

As will be explained later in greater detail, the cable bolt 20 can be anchored in the bore hole 18 with other types of anchor systems. One type, as shown in FIGS. 11 and 12, includes a plurality of tubular members or "buttons" that are crimped or swaged onto the steel cable 22 at selected locations along its length. The diameter of the buttons is slightly less than the diameter of the bore hole 18 so that the cable 22 and buttons can be inserted into the bore hole 18 without obstruction.

The buttons are used with a two component resin system, as described above, or with conventional cement grout. The mixed resin components or grout encapsulates the buttons which serve to compress the resin or grout against the bore hole wall. With the resin bonded to the buttons and the cable bolt 20 and the resin compressed by the buttons into contact with the wall of the bore hole, the cable bolt is securely bonded to the rock formation to resist pull-out of the cable bolt from the bore hole 18.

In addition, the cable bolt 20 may be "birdcaged" as known in the art at selected points along its length. The birdcages are also encapsulated within the mixed resin or grout to compress the material against the rock formation to increase the pull-out resistance of the cable bolt 20.

The insertion of the cable bolt 20 into the rock formation bore hole 18 and rotation of the bolt to anchor it in the bore hole is accomplished by engaging the bolt drive end portion 26 with the drive head of a conventional mine roof drilling and bolting machine. The engagement of the drive end portion 26 with the drive head is facilitated by inserting a portable wrench in the drill head. The portable wrench is positioned on the drive end portion 26 as will be explained later in greater detail.

Transmission of upward thrust and rotation to the cable bolt 20 is accomplished by installing on the cable end portion 32, a chuck (shown in FIG. 2) that includes a plug assembly generally designated by the numeral 50 interlocked with a housing or collar 52. The collar 52 locks the plug assembly 50 in gripping engagement with the cable strands so that rotation applied to plug assembly 50 is transmitted to the cable 22.

Figure 4:
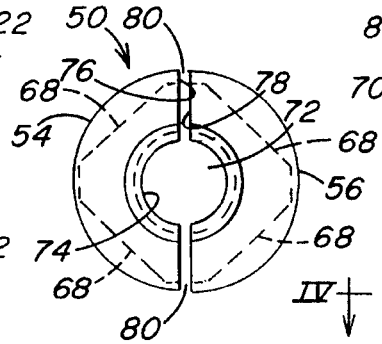
FIG. 4 is a top plan view of the plug member taken along line IV—IV in FIG. 3, illustrating a pair of jaw members forming the plug member positioned in opposed relation to form an axial bore for receiving the end of the cable bolt.
Figure 5:
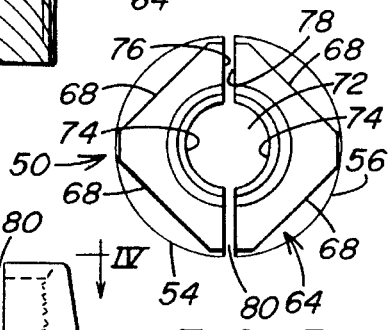
FIG. 5 is a bottom plan view of the plug member taken along line V—V in FIG. 3, illustrating the surfaces of the end of the plug member for transmitting thrust and rotation to the cable bolt.
Figure 3:
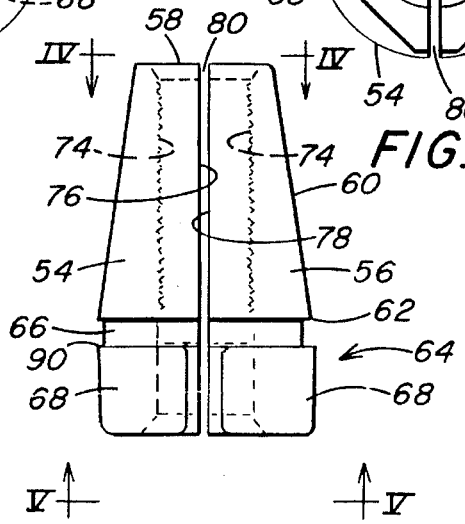
FIG. 3 is a view in side elevation of a plug member of the drive assembly shown in FIG. 2, illustrating a frustoconical outer surface of the plug member and a drive end portion for transmitting rotation to the cable bolt.

As seen in detail in FIGS. 3–5, the plug assembly 50 includes a pair of diametrically opposed jaw members 54 and 56. Each jaw member has a frustoconical outer surface 60. The members 54 and 56 are positioned in opposed relationship, as shown in FIGS. 3–5, to form a frustum of a cone. The frustum has a planar end portion at a reduced end portion 58 and extends therefrom on the outer surface 60 to an enlarged end portion 62 that is separated from a drive end portion 64 by an annular groove 66 that extends a preselected length to the drive end portion 64 formed by a plurality of axially extending planar faces or flats 68.

As seen in FIGS. 4 and 5, the drive end portion 64 extends axially from the groove 66 and includes four flats 68 for engagement with a portable wrench. The end portion 64 can also be hexagonal in shape. The drive end portion 64 may be provided with any number of planar surfaces.

The flats 68 on the plug assembly 50 are spaced or extend a preselected distance from the conical end portion 62 by provision of the annular groove 66. This assures that the portable wrench does not advance beyond the flats 68 on the plug assembly 50 or the housing 52. Also, as will be explained later in greater detail, a length of cable 70 extends out of the plug assembly 50 to be inserted in the portable wrench. When the length of cable 70 bottoms out in the wrench advance of the wrench on the flats 68 is interrupted or stopped. This prevents the wrench from coming into contact with the housing 52 so that torque is applied to the flats 68 and not the housing 52.

When positioned in opposed relationship as shown in FIGS. 4 and 5, the plug assembly 50 forms an axial bore 72. Preferably the bore 72 includes radial teeth or threads 74 for securely gripping the steel cable 22. The threads 74 upon the application of radial pressure deform the surface of the cable 22 so that the material of the cable is forced into the recesses between the threads 74. The deformation and frictional engagement of the steel cable 22 can also be accomplished by knurling or serrating the internal bore 72 of the two-part plug assembly 50.

Figure 2:
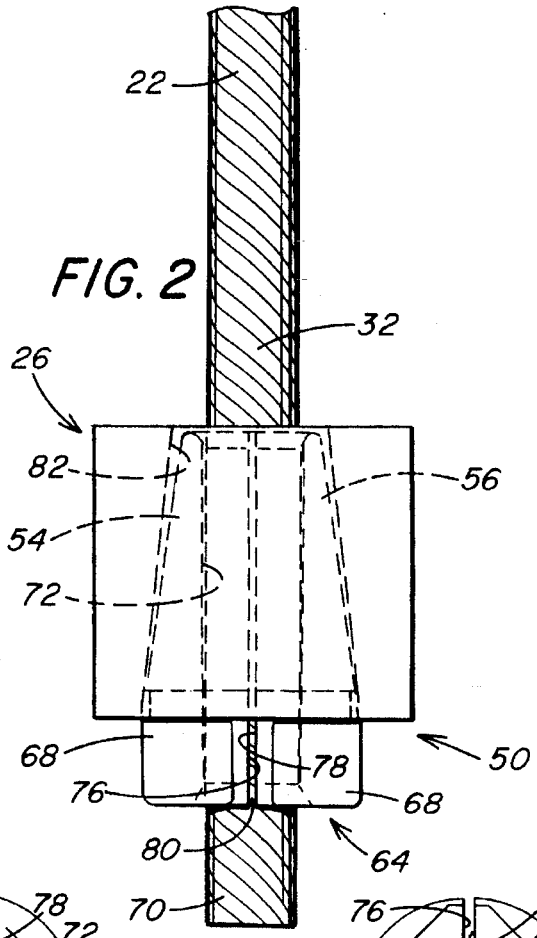
FIG. 2 is an enlarged fragmentary view in side elevation of the drive assembly for transmitting thrust and torque to the end of the cable bolt shown in FIG. 1.
Figure 6:
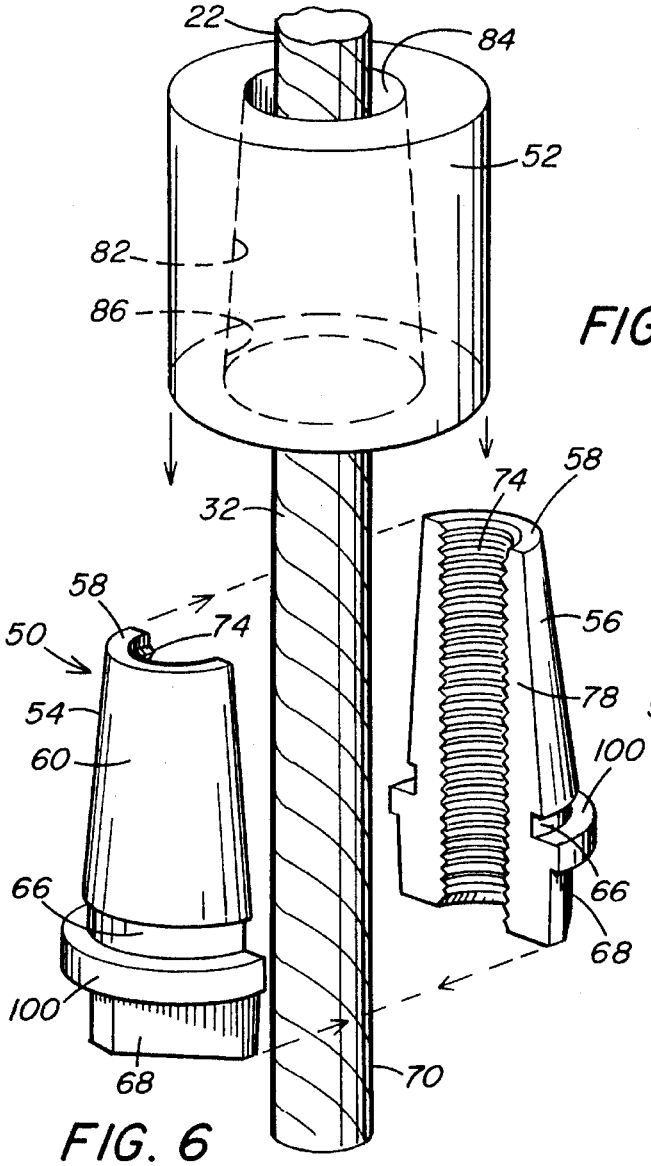
FIG. 6 is a fragmentary, exploded isometric view of the pair of jaw members and the housing that advances on the outer tapered surfaces of the jaw members.

Now referring to FIGS. 2 and 6, there is illustrated the manner in which the two-part plug assembly 50 and housing or collar 52 are connected to the cable end portion 32. The separated jaw members 54 and 56 are positioned oppositely of one another around the cable end portion 32. Preferably the jaw members 54 and 56 are positioned on the cable end portion 32 so that a preselected length of cable 70 extends from the flats 68. The jaw members 54 and 56 are brought into opposed spaced relation with one another surrounding the cable end portion 32. The threads 74 within the bore 72 of the assembled jaw members 54 and 56 contact the surface of the cable 22.

Preferably as seen in FIGS. 3–5, when the jaw members 54 and 56 are brought into surrounding relation with the cable end portion 32 opposing surfaces 76 and 78 of the jaws 54 and 56 remain spaced apart to form a slot 80 that extends the full length of the plug assembly 50. The provision of the slot 80 permits the jaws 54 and 56 to be fully compressed into frictional engagement with the surface of the cable so that movement of the jaws is not restrained by the surfaces 76 and 78 abutting one another.

Once the jaw members 54 and 56 are positioned in opposed relationship surrounding the cable end portion 32 with a length of cable 70 extending below the plug assembly 50, the housing or collar 52 also positioned on the cable above the jaws 54 and 56 is advanced downwardly into surrounding relation with the tapered outer surfaces of the jaw members 54 and 56. The housing 52 includes a bore 82 which is tapered the full length of the housing 52 from a reduced end portion 84 of the bore 82 to an enlarged end portion 86. With this arrangement, the bore 82 also has the configuration of a frustum of a cone. The bore 82 is tapered in a direction opposite to the direction of taper of the outer surface of the plug assembly 50. This relationship is clearly shown in FIG. 2.

As the housing 52 passes downwardly into surrounding relation with the jaw members 54 and 56, the internal tapered surface of the housing 52 urges the jaw members into compressive relation with the cable 22. The threads 74 of the jaw members bite into the surface of the cable so that the jaw members 54 and 56 will not slip relative to the cable. When the plug assembly 50 is rotated, the steel cable 22 rotates with the jaw members 54 and 56.

As seen in FIG. 2, the housing or collar 52 is advanced on the jaw members 54 and 56 surrounding the cable end portion 32 until an end face 88 of the housing 52 is positioned oppositely of or abuts an end shoulder 90 on the planar faces 68. The shoulder 90 can serve as a stop to limit the advance of the collar 52 on the plug assembly 50. When the end face 88 advances closely adjacent to or contacts the shoulder 90, the jaw members 54 and 56 are compressed into frictional engagement with the cable. In this position, the plug assembly 50 is nonrotatably connected to the cable end portion 32.

Below the shoulder 90, the planar faces 68 extend a length to assure that the drive end portion 64 remains out of the housing 52 so that the portable wrench engages the flats 68 and not the housing or collar 52. The drive end portion 64 extends a desired length from the shoulder 90 to firmly seat within the portable wrench so that the housing 52 is removed from engagement with the portable wrench.

By engaging the drive end portion 64 of the plug assembly 50, thrust and torque are efficiently transmitted to the cable bolt 20 without requiring the torque transmitting device to engage the housing 52. It is more advantageous to transmit thrust and torque to the steel cable 22 by direct application to the plug drive end portion 64 than to the housing 52 surrounding the plug assembly 50. It is important that the housing 52 remain longitudinally fixed on the jaw members 54 and 56 so that the jaw members are maintained in frictional engagement with the cable end portion 32.

It has been found that when a portable wrench or the chuck of a torque transmitting device, such as on a mine roof bolter, engages the housing 52, the force of engagement has a tendency to longitudinally displace the housing 52 on the jaw members 54 and 56. If the housing 52 is displaced on the jaw members 54 and 56 to the extent that the jaw members are free to move laterally and longitudinally on the cable end portion 32, the nonrotatable engagement of the jaw members to the cable bolt is lost. The jaw members will then slip on the cable bolt so that the cable will not rotate with the jaw members, preventing installation of the cable bolt 20.

With the present invention, thrust and torque are transmitted directly to the jaw members 54 and 56 which are wedged onto the cable end portion 32 by the housing 52. The housing 52 is not engaged by the portable wrench or chuck of the mine roof bolter. Transmission of torque to the jaws rotates the entire cable bolt 20 in the bore hole 18.

Figure 7:
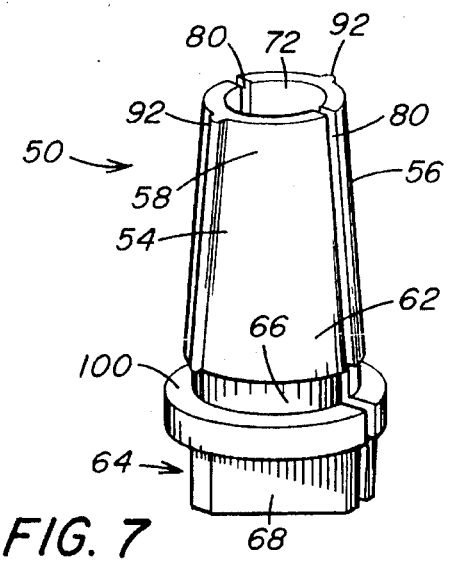
FIG. 7 is an isometric view of another embodiment of the plug member of the present invention.

The plug assembly 50 may also include provision to restrain relative rotational movement between the housing or collar 52 and the surface of the jaw members 54 and 56. In one embodiment, as illustrated in FIG. 7, each jaw member 54 and 56 includes a protrusion or rib 92 that extends outwardly from the surface of the jaw member. The protrusion 92 extends the full length of the tapered surface 60. To receive the protrusions 92, the housing 52 is provided with diametrically opposed recesses (not shown) that extend into the body of the housing from the tapered bore 82. The recesses receive the protrusions 92 so that the housing 52 and plug assembly 50 rotate as a single unit upon rotation of the plug assembly.

Figure 10:
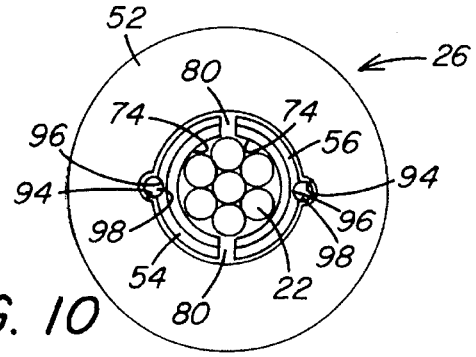
FIG. 10 is top plan view of the assembled plug member and housing taken along lines X—X of FIG. 8, illustrating the nonrotatable engagement of the housing with the plug member.
Figure 8:
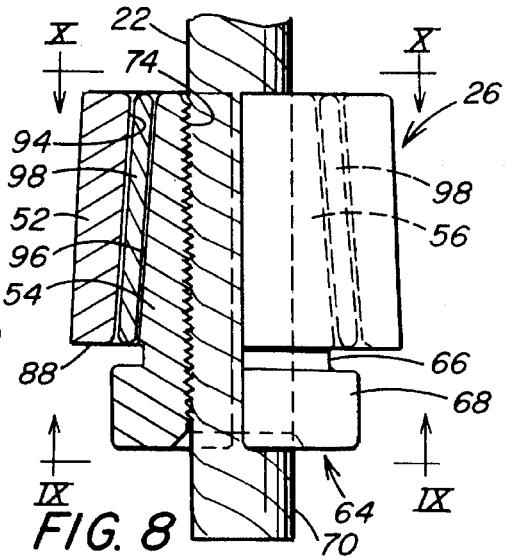
FIG. 8 is a fragmentary, sectional view in side elevation of another embodiment of the drive assembly, illustrating pins in slots for nonrotatably engaging the housing to the jaws of the plug member gripping the cable bolt.
Figure 9:
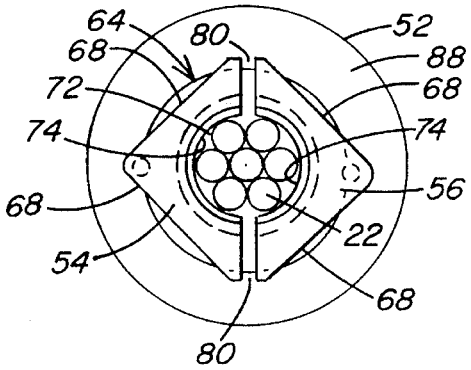
FIG. 9 is a bottom plan view of the assembled plug member and housing taken along line IX—IX of FIG. 8, illustrating the plug member engaged by the housing in gripping engagement with the strands of the cable bolt.

Referring to FIGS. 8–10, there is illustrated another embodiment for nonrotatably connecting the housing 52 to the plug assembly 50. The housing 52 and the plug assembly 50 are provided with complementary opposing slots 94 and 96 respectively. The slots 94 and 96, as seen in FIG. 8, extend substantially the entire length of the housing 52 and the plug assembly 50. The complementary slots 94 and 96 form keyways for receiving pins or keys 98.

The pins 98 extend the length of the keyways to nonrotatably engage the housing 52 to the plug assembly 50. Therefore, when torque is applied to the plug end portion 64, the housing 52 rotates with the plug assembly 50 and does not slip or rotate relative to the plug assembly 50. This serves to maintain the housing 52 wedged into the plug assembly 50 so that the jaw members 54 and 56 remain frictionally engaged to the steel cable 22.

Referring to FIGS. 9 and 10, the steel cable 22 is formed by a plurality of steel strands, for example, six peripheral steel strands which are wrapped in a continuous spiral around a center steel strand. The sharp edges forming the threads 74 on each of the jaw members 54 and 56 are forced into gripping engagement with the peripheral steel strands. By maintaining the housing 52 nonrotatably connected to the jaw members 54 and 56 and longitudinally fixed thereon, the housing 52 maintains the jaw members 54 and 56 compressed onto the strands of the steel cable 22.

The embodiment of the plug assembly 50 shown in FIGS. 6 and 7 includes the drive end portion 64 having flats 68, as above described, with the provision of an annular shoulder 100 extending outwardly between the groove 66 and the flats 68 for receiving the end of the housing 52 on the assembled jaw members 54 and 56. With the embodiment shown in FIG. 8, the shoulder 100 is not utilized. The shoulder 100 serves as a stop to limit downward movement of the housing 52 on the jaw members 54 and 56 and restrain upward advancement of the wrench past the flats 68. This prevents the portable wrench from engaging or contacting the housing 52 wedged on the jaw members 54 and 56.

The drive end portion 26 of the cable bolt 20 illustrated in FIGS. 2–5 and 6–10 can be used with cable bolts utilizing mechanical expansion shell assemblies, as shown in FIG. 1, with or without chemical bonding by resin or cement grout and with cable bolts that utilize buttons, as shown in FIGS. 11 and 12, for anchoring the cable bolt 20 in the bore hole 18. As shown in both FIGS. 1 and 11, the drive end portion 26 retains a bearing plate 102 on the cable end portion 32.

Positioned above and in contact with the bearing plate 102 is a stiffener 103 having a tubular configuration through which the cable end portion 32 extends. The provision of the stiffener 103 serves to rigidify the end portion 32 of the cable bolt 20 as it is inserted and rotated upwardly into the bore hole 18. If the viscosity of the mixed resin in the bore hole 18 is relatively low, the stiffener 103 can be deleted from the cable bolt 20. It can also be deleted for installation where an expansion shell assembly is used without chemical bonding the cable bolt 20 in the bore hole 18.

The stiffener 103 has an axial bore that exceeds the diameter of the steel cable 22 and an external diameter that is less than the diameter of the bore hole to facilitate ease and installation on the cable and insertion into the bore hole. The stiffener 103 and the bearing plate 102 are positioned on the cable end portion 32 before the drive end portion 26 is installed on the cable end portion.

As illustrated in FIG. 1, the cable bolt 20 having the expansion shell assembly on the anchor end portion 24 is advanced into the bore hole to the point where the bearing plate 102 supported by the drive end portion 26 is compressed against the mine roof 16. At this point a portable wrench is positioned in engagement with the drive end portion 64 of the plug assembly 50 and received within a chuck of a drill head to rotate the cable bolt 20 to expand the fingers 48 of the shell 46 to anchor the cable bolt under tension in the bore hole 18.

With the embodiment of the cable bolt 20 shown in FIGS. 11 and 12, a two component resin cartridge 109, as above described, is inserted into the bore hole 18 ahead of the cable bolt 20. The cable bolt 20 includes a plurality of anchor buttons 104 secured at selected positions along the length of the steel cable 22. The buttons 104 are cylindrical in configuration and are crimped or swaged at selected intervals on the steel cable 22.

As shown in FIG. 11, a portable wrench 105 having an internal socket 107 is advanced on the length of cable 70 that extends below the flats 68 of the plug assembly 50. The length of the cable portion 70 is selected to assure that when the wrench 105 is advanced on the cable portion 70, the cable portion 70 bottoms out in the socket 107, as shown in FIGS. 11 and 12, before the wrench 105 contacts the housing 52. The cable portion 70 contacting the bottom of the socket 107 serves as a stop for advancement of the wrench 105 on the drive end portion 64. The wrench 105 advances into engagement with the flats 68 on the end of the plug assembly 50, but not into engagement with the housing 52.

Once the wrench 105 is positioned on the end of the plug assembly 50, as shown in FIG. 11, the wrench is inserted in the chuck or drive head of a mine roof drilling and bolting machine or similar torque transmitting device. Torque applied to the wrench 105 is transmitted through the flats 68 to the plug assembly 50 to rotate the cable. As shown in FIG. 12, the wrench 105 is also engaged to apply upward thrust of the cable bolt 20 in the bore hole 18. In both the application of rotation and thrust to the cable bolt 20, the housing 52 is not engaged by the wrench 105 and remains nonrotatably connected to the plug assembly 50.

The cable bolt 20 with the buttons 104 is first advanced upwardly into the bore hole to compress the resin cartridge 109 against the closed end 30 of the bore hole 18. The cable bolt 20 is advanced further until the end portion 34 is positioned several inches away from the end 30 of the bore hole. The cable bolt 20 is then rotated by the application of torque through the wrench 105 to the plug assembly 50.

The cable bolt 20 is rotated to mix the resin and the catalyst components to form a mixed resin 106 that flows downwardly in the bore hole 18 in surrounding relation with the buttons 104 and the steel cable 22. The steel cable 22 and the buttons 104 become encapsulated within the mixed resin 106. The buttons 104 compress the mixed resin 106 into contact with the wall of the bore hole to form a secure bonding of the mixed resin 106 with the surrounding rock formation. The resin 106 is also bonded to the steel cable 22 and buttons 104.

Before the mixed resin hardens, the portable wrench 105 positioned in the chuck of a mine roof bolter is thrust upwardly to advance the cable bolt 20 to compress the bearing plate 102 against the mine roof 16. The cable bolt 20 is rotated for the period of time required to completely mix the resin components. When the components are thoroughly mixed, rotation of the cable bolt 22 is stopped while an upward force is maintained on the bolt to hold the bearing plate 102 against the rock formation until the resin begins to harden. In comparison with the cable bolt 20 illustrated in FIG. 1 which is tensioned in the bore hole 18, the embodiment of the cable bolt 20 shown in FIGS. 11 and 12 is not placed in tension.

Now referring to FIGS. 13–16, there is illustrated further embodiments of the cable bolt 20 of the present invention which include apparatus for tensioning a resin anchored cable bolt in a bore hole. In the embodiment illustrated in FIGS. 13 and 14, only the lower end portion of the cable bolt 20 is illustrated. It should be understood that the cable bolt 20 shown in FIGS. 13 and 14 can include buttons secured at selected points along the length of the cable 22 as shown in FIGS. 11 and 12. This embodiment can also utilize the resin cartridge 109 or cement grout to anchor the upper end portion of the cable bolt 20 within the bore hole. Also, in place of the buttons 104 to compress the mixed resin in the bore hole, birdcages may be utilized on the steel cable 22.

Figure 13:
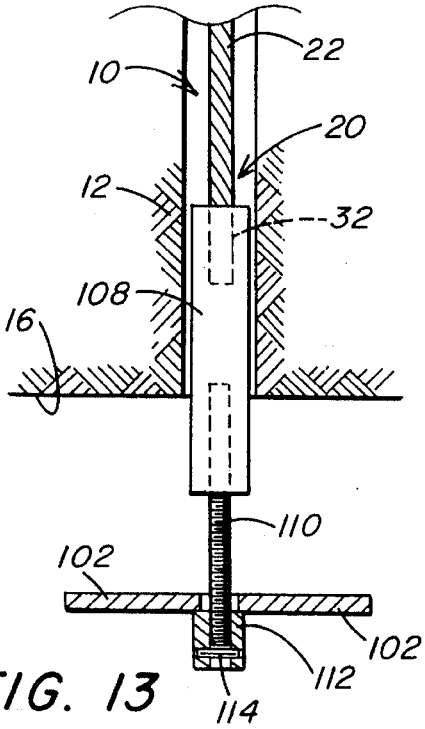
FIG. 13 is a partial sectional, fragmentary view in side elevation of a further embodiment of the cable bolt of the present invention, illustrating a torquing nut mounted on a threaded stud secured to the end of the cable bolt for tensioning the cable in the bore hole.
Figure 14:
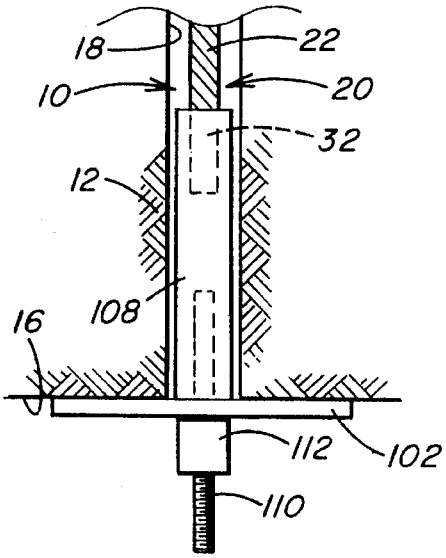
FIG. 14 is a view similar to FIG. 13 of the cable bolt, illustrating the torquing nut advanced on the threaded stud to compress a roof plate against the rock formation and tension the anchored cable bolt in the bore hole.

The cable bolt 20 shown in FIG. 13 does not utilize the drive end portion 64 described above and illustrated in FIGS. 1–12. In place of the drive end portion 64 the cable end portion 32 is swaged or crimped to the upper end portion of a tubular fitting 108. The opposite end of the fitting 108 is internally threaded to receive a threaded stud 110. An internally threaded nut 112 is advanced onto the end of the stud 110 until a shear pin 114 in the nut engages the end of the stud 110 to restrain further rotation of the nut 112. The nut 112 also retains the bearing plate 102 on the stud 110.

On installation the cable bolt 20 shown in FIG. 13 is advanced upwardly into the bore hole 18 with a resin cartridge positioned ahead of the end of the bolt. Upward advancement of the bolt moves the cartridge to the end of the bore hole where it is compressed and ruptured. After rotation of the bolt 20 to thoroughly mix the resin components, the bolt is held stationary as the mixed resin begins to harden. After a preselected interval the nut 112 is rotated. With the cable 20 restrained against rotation within the bore hole by the hardened resin the resistance to rotation of the cable breaks the shear pin 114 to permit the nut 112 to advance on the threaded stud 110. The nut 112 is advanced to move the bearing plate 102 against the mine roof. A preselected torque is applied by the portable wrench (not shown) to the nut 112 to place the anchored cable bolt 20 in tension.

Figure 15:
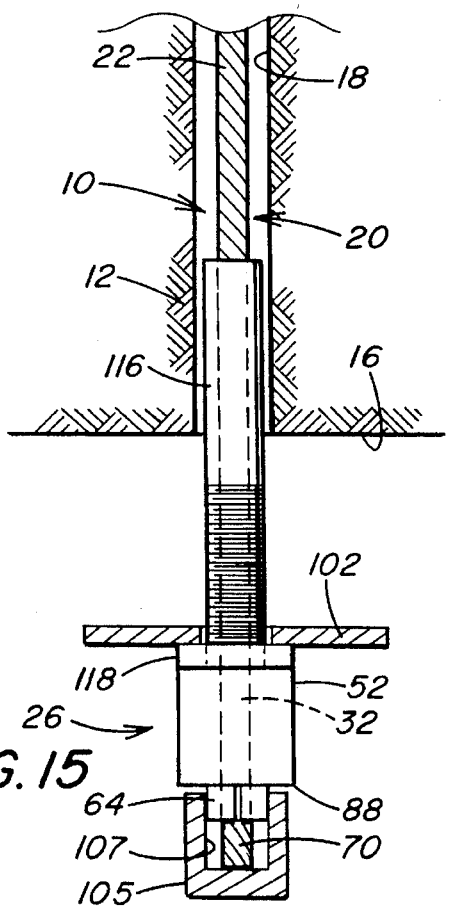
FIG. 15 is a partial sectional, fragmentary view in side elevation of a further embodiment of the cable bolt of the present invention, illustrating a drive assembly engaged to the end of the cable bolt and a torquing nut engaging a stiffener swaged onto the end of the cable bolt.
Figure 16:
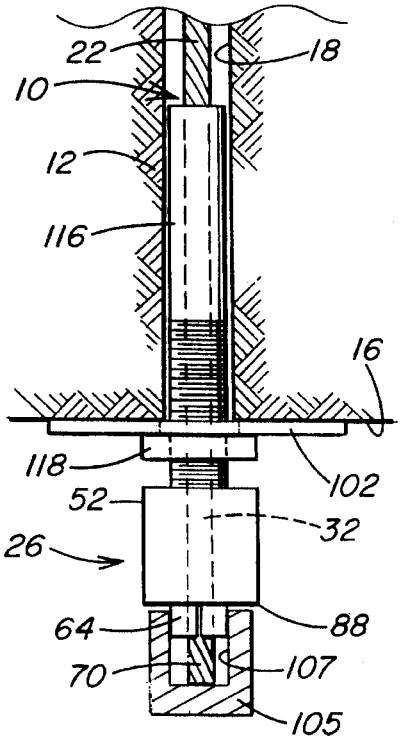
FIG. 16 is a view similar to FIG. 15, illustrating the cable bolt advanced upwardly in the bore hole and the nut rotated on the stiffener to compress a bearing plate against the rock formation and tension the anchored cable bolt in the bore hole.

A similar arrangement for tensioning a resin or a cement grout bonded cable bolt in a bore hole is shown in FIGS. 15 and 16. With this embodiment of the present invention, the above described drive end portion 26 is advanced into the portable wrench 105 until the length of cable 70 bottoms out in the socket 107. Thus, the length of cable 70 limits the advance of the portable wrench on the plug assembly 50 and prevents the wrench from engaging the housing 52. A stiffener 116 is also utilized; however, unlike the stiffener 100 illustrated in FIGS. 1 and 11, the stiffener 116 shown in FIG. 15 has an externally threaded surface to receive a torquing nut 118.

The embodiment of the cable bolt 20 shown in FIG. 15 uses resin or cement grout to anchor the upper end portion of the bolt 20 in the bore hole 18 as described above. Once the adhesive material is positioned in the bore hole around the cable bolt 20 and has been allowed to harden for a period of time, the nut 118 is advanced on the externally threaded stiffener 116. Upward advancement of the nut 118 moves the bearing plate 102 into compressive relation with the surface of the rock formation surrounding the bore hole 118. The nut 18 is rotated until a preselected torque is applied to the anchored cable bolt 20 to place it in tension within the bore hole. As with the above described embodiments, the portable wrench 105 engages the flats 68 of the plug assembly 50 to rotate the cable bolt 20 without engaging the housing 52.

According to the provisions of the patent statutes, we have explained the principle, preferred construction, and mode of operation of our invention and have illustrated and described what we now consider to represent its best embodiment. However, it should be understood that within the scope of the appended claims, the invention may be practiced otherwise than as specifically illustrated and described.

We claim:

1. A method for supporting a rock formation comprising the steps of, installing an anchor assembly on one end of a multistrand cable of a preselected length, advancing the anchor assembly on the cable in a bore hole of the rock formation to position the anchor assembly at a preselected depth in the bore hole, extending an opposite end of the cable out of the bore hole, positioning a plug member on the end of the cable extending out of the bore hole, advancing a housing into wedging engagement with the outer surface of the plug member to compress the plug member into nonrotational gripping engagement with the cable, projecting from the housing a drive end portion of the plug member surrounding the end of the cable extending out of the bore hole, nonrotatably engaging a wrench to the drive end portion of the plug member, applying torque to the wrench to rotate the plug member and the cable in the bore hole, and applying an upward force on the drive end portion of the plug member to advance the anchor assembly in the bore hole into engagement with the rock formation to anchor the cable in the bore hole to support the rock formation.

2. A method as set forth in claim 1 which includes, extending a preselected length of the cable from the end of the plug member, positioning the length of the cable in a socket of a wrench to advance the wrench into nonrotatable engagement with the end of the plug member, and limiting the advance of the end of the plug member into the wrench by contact of the cable with the wrench socket to maintain the wrench spaced from engagement with the housing.

3. A method as set forth in claim 1 which includes, nonrotatably engaging the housing to the plug member to rotate the housing and the plug member as a single unit upon rotation of the plug member.

4. A method as set forth in claim 1 which includes, inserting a volume of mixed adhesive material in the bore hole surrounding the anchor assembly on the cable, and adhesively bonding the cable to the rock formation surrounding the bore hole upon curing of the adhesive material in the bore hole.

5. A method as set forth in claim 1 which includes, applying rotation to the end of the cable at the opening of the bore hole with the opposite end of the cable anchored in the bore hole to place the cable in tension and reinforce the rock formation surrounding the bore hole.

6. A method as set forth in claim 1 which includes, limiting advance of the housing on the tapered surface of the plug member to maintain the end portion of the plug member extending from the housing, providing flats on the end portion of the plug member for nonrotatable engagement with a wrench, and positioning the wrench in engagement with the flats and removed from contact with the housing.

7. A method as set forth in claim 6 which includes, extending a length of cable below the end portion of the plug member, and advancing the length of cable into contact with a socket of the wrench to stop the advance of the wrench into engagement with the flats and removed from engagement with the housing.

8. A drive assembly for an end of a flexible cable comprising, a chuck formed by a pair of jaw members positioned in opposed relation with an axial bore extending therethrough for receiving the end of the flexible cable, said pair of jaw members having a frustoconical outer surface tapering in diameter from an enlarged end portion to a reduced end portion, a housing having a bore for receiving said jaw members, said housing bore being tapered in a direction opposite to the direction of taper of said jaw members frustoconical outer surface, said housing positioned in surrounding relation with said jaw members and axially advanced on said frustoconical outer surface from said reduced end portion to said enlarged end portion to urge said jaw members into nonrotatable gripping engagement with the flexible cable, means extending from said enlarged end portion for receiving said housing in a fixed position compressing said jaw members on said cable, and said means having a drive end portion extending from said housing for receiving a drive mechanism for transmitting torque or thrust to the cable.

9. A drive assembly as set forth in claim 8 in which, said means extending from said enlarged end portion for receiving said housing includes an annular shoulder positioned on said jaw members enlarged end portion, and said annular shoulder forming an abutment surface limiting axial advance of said housing on said frustoconical outer surface.

10. A drive assembly as set forth in claim 8 in which, said drive end portion includes a plurality of flats axially spaced from said enlarged end portion, said flats nonrotatably receiving the drive mechanism for transmission of torque or thrust thereto, and said housing spaced from said flats.

11. A drive assembly as set forth in claim 8 which includes, means for nonrotatably connecting said housing to said jaw members so that said housing and said jaw members rotate as a single unit when torque is applied to the cable.

12. Apparatus for supporting a rock formation comprising, a multi-strand cable of a preselected length having a first end portion for anchoring in a bore hole of the rock formation and a second end portion positioned adjacent to the opening into the bore hole, a chuck having at least a pair of jaws for frictionally engaging said cable second end portion, said chuck having an end portion extending out of the bore hole, means for nonrotatably connecting said chuck to said cable second end portion, said cable second end portion including a segment of said cable projecting from said chuck end portion, torque transmitting means positioned on said chuck end portion for rotating said cable, and said cable segment stopping advance of said torque transmitting means on said cable second end portion when said torque transmitting means engages said chuck.

13. Apparatus for supporting a rock formation as set forth in claim 12 in which, said chuck end portion has a plurality of flats for receiving said torque transmitting means, and said torque transmitting means advanced axially on said flats until said torque transmitting means abuts said cable second end portion to locate said torque transmitting means in engagement with said flats.

14. Apparatus for supporting a rock formation as set forth in claim 13 in which, said torque transmitting means includes a wrench having an internal socket with an abutment surface, and said cable second end portion advanced into said wrench socket and into contact with said abutment surface to position said wrench in nonrotatable engagement with said flats.

15. Apparatus for supporting a rock formation as set forth in claim 12 which includes, means for anchoring said cable first end portion to the rock formation surrounding the bore hole to secure said cable against longitudinal movement in the bore hole, and tensioning means positioned on said cable second end portion for placing said cable anchored in the bore hole in tension to reinforce the surrounding rock formation.

16. An apparatus for supporting a rock formation comprising:

(a) a multi-strand cable of a preselected length;

(b) a plug member having an axial bore for engaging an end of said cable, a reduced end portion, an enlarged end portion, an outer surface tapering from said reduced end portion to said enlarged end portion, and a drive end portion; and (c) a housing having a tapered bore for receiving said plug member, said tapered bore being tapered in a direction opposite to the direction of taper of said plug member outer surface to permit said housing to advance on said plug member and urge said plug member into frictional engagement with said cable, wherein said drive end portion extends out of said housing to receive torque for transmitting rotation from said plug member to said cable.

17. The apparatus of claim 16 further comprising flats on said drive end portion for engagement by a torque transmitting device to rotate said cable.

18. The apparatus of claim 17 wherein said flats form an annular shoulder on said plug to receive said housing and restrain movement of said housing onto said flats.

19. The apparatus of claim 16 wherein said enlarged end portion comprises an abutment surface extending radially outwardly from said tapered outer surface and positioned opposite said housing to prevent axial advancement of said housing past said abutment surface.

20. The apparatus of claim 16 further comprising a means for nonrotatably engaging said housing to said plug member so that said housing and said plug member rotate as a single unit upon rotation of said plug member.

21. The apparatus of claim 16 further comprising a stop on said cable end portion positioned below said housing for preventing a torque transmitting device from engaging said housing and only engaging said plug member drive end portion.

22. The apparatus of claim 21 wherein said stop includes an annular shoulder on said plug member enlarged end portion for abutting said housing to maintain said housing spaced from the point of application of torque on said plug member enlarged end portion.

23. The apparatus of claim 22 wherein said stop includes a portion of said cable extending from said plug member drive end portion to maintain a torque transmitting device spaced apart from said housing.

* * * * *